US006074132A

United States Patent [19]

Davies et al.

[11] Patent Number: 6,074,132

[45] Date of Patent: Jun. 13, 2000

[54] LINING FOR A LANDFILL SITE

[75] Inventors: Michael Leonard Davies, Shrewsbury; Ian Michael Spencer, Holbrook Moor Nr Belper, both of United Kingdom

[73] Assignee: Hanson Quarry Products Europe Limited, Bristol, United Kingdom

[21] Appl. No.: 09/155,732

[22] PCT Filed: Apr. 6, 1996

[86] PCT No.: PCT/GB96/00842

§ 371 Date: Oct. 5, 1998

§ 102(e) Date: Oct. 5, 1998

[87] PCT Pub. No.: WO97/38174

PCT Pub. Date: Oct. 16, 1997

[51] Int. Cl.[7] ..... B09B 1/00; E02D 29/02

[52] U.S. Cl. ..... 405/129; 405/128; 405/267; 405/270

[58] Field of Search ..... 405/286, 287, 405/128, 129, 266, 267, 107, 108, 258, 270

[56] References Cited

U.S. PATENT DOCUMENTS

| | | | |
|---|---|---|---|
| 4,329,089 | 5/1982 | Hilfiker et al. | 405/287 X |
| 4,391,557 | 7/1983 | Hilfiker et al. | 405/287 |
| 4,659,252 | 4/1987 | Sexton et al. | 405/107 X |
| 4,911,582 | 3/1990 | Peirce et al. | 405/287 X |
| 5,356,242 | 10/1994 | Elmore et al. | 405/287 X |
| 5,472,297 | 12/1995 | Heselden | 405/286 |
| 5,570,974 | 11/1996 | Jax et al. | 405/129 |
| 5,599,139 | 2/1997 | Chewning et al. | 405/129 |
| 5,647,695 | 7/1997 | Hilfiker et al. | 405/287 X |

FOREIGN PATENT DOCUMENTS

| | | |
|---|---|---|
| 1202190 | 3/1986 | Canada . |
| 2607534 | 6/1988 | France . |
| 680599 | 9/1992 | Switzerland . |
| 2239036 | 6/1991 | United Kingdom . |

*Primary Examiner*—Dennis L. Taylor
*Attorney, Agent, or Firm*—Baker Botts L.L.P.

[57] ABSTRACT

A method of lining a side face (11) of a landfill site comprising the steps of erecting a framework (10) including laterally spaced substantially vertically extending members (12) adjacent the surface of the side face (11), covering the framework (10) with a wire mesh (15), filling the space between the mesh (15) and the side face (11) with pieces of substantially inert material (16), laying an impermeable liner (17) over the wire mesh (15) and constructing a retaining wall (20) over the liner (9), wherein the vertically extending members (12) are tubular and have spaced apertures thereto along their lengths.

13 Claims, 2 Drawing Sheets

LINING FOR A LANDFILL SITE

This invention concerns a lining for a landfill site.

British Patent No. 2239036 discloses a method of lining a side face of a landfill site wherein a flexible impermeable liner is located between inner and outer walls which are constructed from loosely assembled pieces of substantially inert material held in position adjacent to the side face of the site. In a preferred arrangement the walls are comprised by block-shaped baskets of wire mesh loosely packed with pieces of stone or-rock and known as "gabions". The patent also discloses the possibility of incorporating vertically extending pipes or ducts within the gabion walls for monitoring gas and leachate at various positions and on either side of the liner.

The present invention provides a novel method of lining a side face of a landfill site which enables monitoring of the integrity of the liner in a particularly expeditious manner.

According to the present invention there is provided a method of lining a side face of a landfill site comprising the steps of erecting a framework including laterally substantially vertically extending members adjacent the surface of the side face, covering the framework with a wire mesh, filling the space between the mesh and the side face with pieces of substantially inert material, laying an impermeable liner over the wire mesh and constructing a retaining wall over the liner, wherein the vertically extending members are tubular and have spaced apertures thereto along their lengths.

The impermeable liner may be sandwiched between layers of protective geotextile material.

The liner may be of high density polyethylene.

The retaining wall may be a gabion wall.

The framework may carry a track along its upper edge along which a carriage supporting rolls of geotextile or liner may run to facilitate deployment of same.

The invention will be further apparent from the following description with reference to the several figures of the accompanying drawings, which show, by way of example only, one form of lining for a landfill site embodying the methods of the invention.

It should be understood that the drawings are diagrammatic only and that in practice the lining might have considerable height to cover the side faces of a disused quarry for example.

Figure 1:
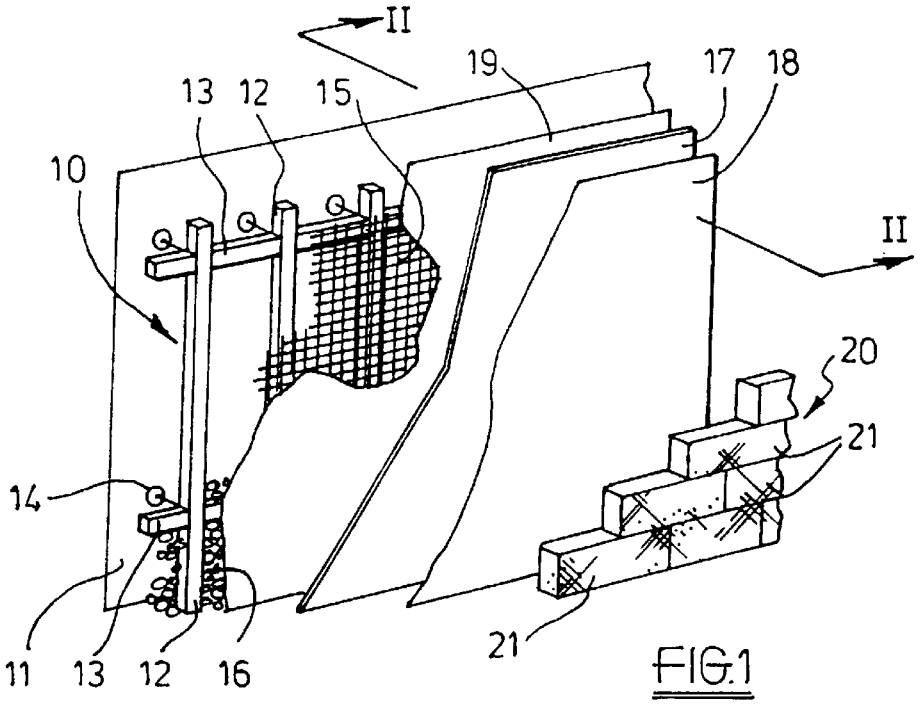
FIG. 1 shows a cut-away and exploded perspective view of part of the lining.
Figure 2:
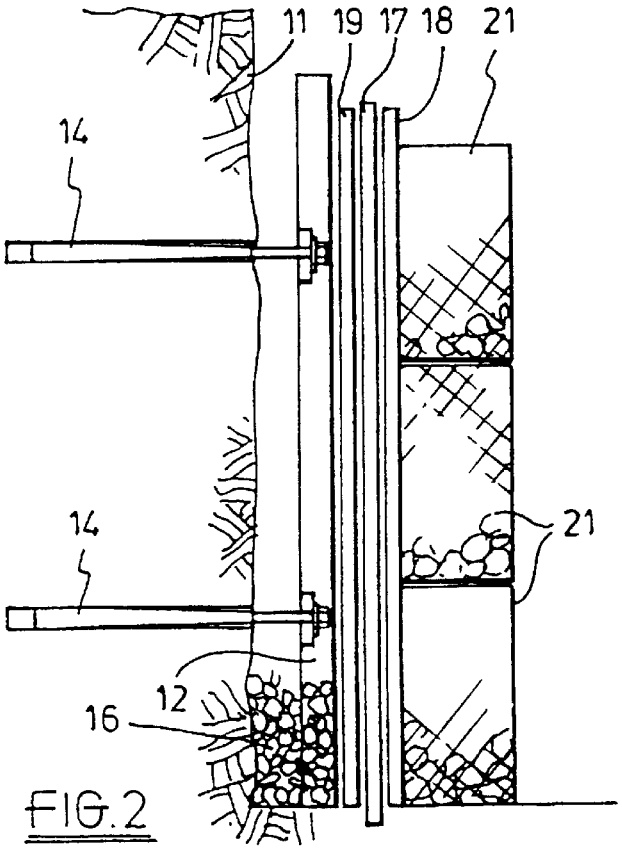
FIG. 2 shows a cross-section through the lining on the line II—II of FIG. 1.

Referring firstly to FIGS. 1 and 2 it will be seen that the lining is comprised by a framework 10 lying in a substantially vertical plane as closely adjacent the side face 11 of a disused quarry as possible having regard to the irregularities of such side face.

The framework 10 comprises vertical members 12 of box-section and horizontal members 13 also of box-section, and is secured by rockbolts 14.

The framework 10 is covered by a wire mesh 15 and the space between the mesh 15 and the face 11 is loosely filled with pieces 16 of stone and rock sized from 5 to 10 centimeters upwards.

The mesh 15 is covered by an impervious liner 17 of high density polyethylene sandwiched betweeen inner and outer protective layers 18 and 19 of geotextile.

The liner 17 is held in position by a retaining wall 20 constructed from gabions 21, which is to say block-shaped baskets of wire mesh filled with pieces of stone and rock.

Figure 3:
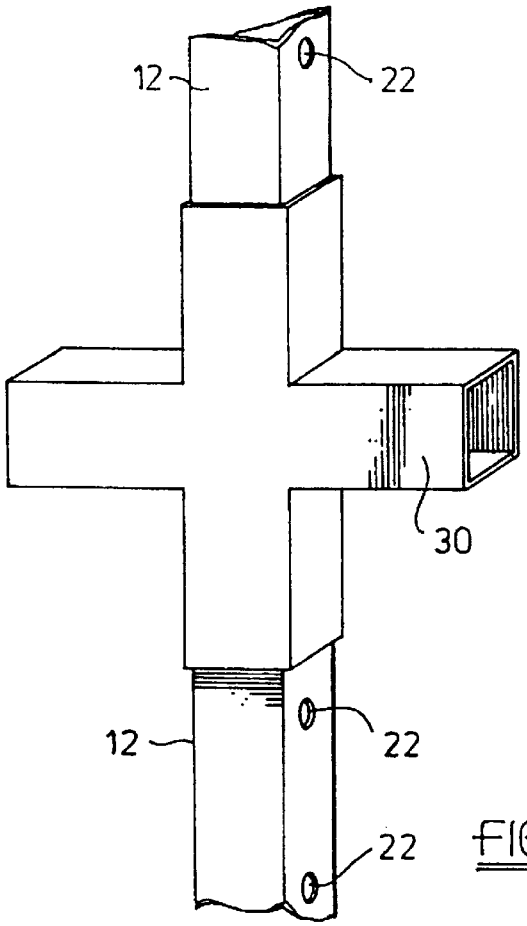
FIG. 3 shows a perspective view of a detail of the framework of the lining of FIG. 1 on an enlarged scale.

Turning now to FIG. 3, it will be seen that the junctions between the vertical and horizontal members 12 and 13 of the framework 10 are provided by cruciform connecting members 30, which are themselves of hollow contruction to preserve a passage through the vertical members 12 over the full height of the framework 10.

Apertures 22 are provided in the sides of the members 12 at spaced intervals along their lengths.

Typically the members 12 will be spaced apart by 1.5m and since they lie on the outside (i.e. quarry face side) of the liner 17, the integrity of the liner can be closely monitored by instruments analysing any gas or leachate present within the members 12. Such instruments may provide continuous monitoring or may be deployed (for example lowered through the members 12) as required. Narrow bore pipes (of plastics for example) may be installed through the members 10 to enable leachate to be pumped to the surface for analysis.

When any fault in the liner 17 might be detected the possibility of repair by pumping a sealant such as a cementitious grout to the damaged site through the nearest members 12 is present.

Figure 4:
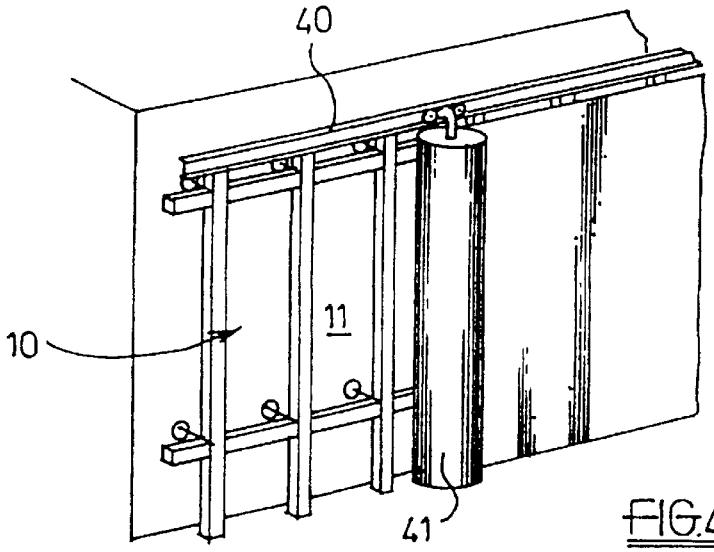
FIG. 4 shows how the framework may incorporate a track along its upper edge to facilitate construction of the lining.

Referring now to FIG. 4 it can be seen how the framework 10 might support a monorail track 40 along its upper edge to carry machines supporting rolls 41 of liner or geotextile to facilitate their installation.

It will be appreciated that it is not intended to limit the invention to the above example only, many variations, such as might readily occur to one skilled in the art, being possible, without departing from the scope thereof.

Thus for example, the apertures to the interior of the vertical members might be provided only by unsealed joints at the members 30 or by apertures in the members 30 themselves.

Again, for example, a Bentonite or similar membrane may be included in juxtaposition with the impermeable liner.

What is claimed is:

1. A method of lining a side face of a landfill site comprising the steps:

(a) erecting a framework having a first side adjacent the side face and a second side opposite from the first side, the frame work including laterally spaced-apart substantially vertically extending tubular members with spaced apertures along their lengths;

(b) covering the second side of the framework with a wire mesh;

(c) filling the space between the mesh and the side face with pieces of a substantially inert material;

(d) laying an impermeable liner over the wire mesh; and (e) constructing a retaining wall over the liner.

2. A method according to claim 1, including the step of sandwiching the impermeable liner between layers of a protective geotextile material.

3. A method according to claim 1, wherein said step of laying an impermeable liner includes laying a high density polyethylene.

4. A method according to claim 1 wherein the constructing of a retaining wall includes forming a gabion wall.

5. A method according to claim 1 wherein the step of erecting the framework includes the further step of attaching vertically spaced horizontal members to the vertical members.

6. A method according to claim 5 wherein the erecting step includes providing cruciform connecting members at junctions between the vertical and horizontal members.

7. A method according to claim 6 further comprising preserving passages through the vertical members over the fill height of the framework by the provision of hollow connecting members.

8. A method according to claim 1 wherein the framework carries a track along its upper edge and wherein the step of laying an impermeable layer includes operating a carriage supporting rolls of liner along the track to facilitate deployment of the impermeable layer.

9. A method according to claim 2 wherein the framework carries a track along its upper edge and wherein the step of laying an impermeable layer includes operating a carriage supporting rolls of a geotextile material along the track to facilitate laying the impermeable layer.

10. A method of protecting a side face of a landfill site from contamination comprising the steps:

(a) erecting a framework having a first side adjacent the side face and a second side opposite from the first side, the frame work including laterally spaced-apart substantially vertically extending tubular members with spaced-apart apertures along their lengths;

(b) covering the second side of the framework with a wire mesh;

(c) filling the space between the mesh and the side face with pieces of a substantially inert material;

(d) laying an impermeable liner over the wire mesh;

(e) constructing a retaining wall over the liner; and (f) monitoring the content within at least one of the tubular members to detect contaminants entering the apertures of the framework indicative of a breach in the impermeable layer.

11. The method of claim 10 wherein the step of monitoring includes the step of periodically lowering a measurement device into at least one of the tubular members.

12. The method of claim 10 wherein the step of monitoring includes the step of extracting one of a leachate or a gas from at least one of the tubular members for subsequent analysis.

13. The method of claim 10 further comprising the step of injecting a sealant into a tubular member where a contaminant has been detected to repair a breach in the impermeable layer.

* * * * *